US006109082A

United States Patent [19]

Taylor et al.

[11] Patent Number: 6,109,082

[45] Date of Patent: Aug. 29, 2000

[54] AUTOMATIC SET-UP WIRE DRAWER

[75] Inventors: Timothy J. Taylor, Roscoe; John T. Kline, Pecatonica; Vernon W. Wanner, Belvidere, all of Ill.

[73] Assignee: Rockford Manufacturing Group, Inc., S. Beloit, Ill.

[21] Appl. No.: 09/323,654

[22] Filed: Jun. 1, 1999

[51] Int. Cl.[7] ..... B21C 1/14

[52] U.S. Cl. ..... 72/14.8; 72/289

[58] Field of Search ..... 72/280, 289, 274, 72/14.8

[56] References Cited

U.S. PATENT DOCUMENTS

| | | | |
|---|---|---|---|
| 3,470,723 | 10/1969 | Remner | 72/289 |
| 3,496,751 | 2/1970 | Knouse | 72/289 |
| 3,827,274 | 8/1974 | Schuetz | 72/289 |
| 4,099,403 | 7/1978 | Alcock et al. | 72/288 |
| 4,532,791 | 8/1985 | McLaughlin | 72/289 |
| 5,097,688 | 3/1992 | Taylor et al. | 72/5 |

FOREIGN PATENT DOCUMENTS

| | | | |
|---|---|---|---|
| 2078583 | 1/1982 | United Kingdom | 72/289 |

*Primary Examiner*—Daniel C. Crane
*Attorney, Agent, or Firm*—Leydig, Voit & Mayer

[57] ABSTRACT

An automatic set-up system for a wire drawing machine. The present invention provides an apparatus and method for substantially automating the set-up process for a wire drawing machine, including the steps of attaching the end of a wire coil to a power-driven capstan, wrapping a sufficient number of wire wraps around the capstan, releasing the end of the wire from the capstan, and feeding the wire to a downstream compensation arm and production machine. Through the use of the present invention, the initialization or set-up process is substantially automated in that the operator simply needs to present wire to the machine, and initiate the process to automatically perform the set-up function and ultimately feed the wire to the downstream production machine. Moreover, due to greatly reduced operator interaction the machine is more reliably set up, and the operator is less likely to be caught or injured by the machine.

27 Claims, 11 Drawing Sheets

20
28
48
50
24
44
108
32
94
74
42
38
46
92
30
102
93
102
88
95
106
91
22
97
96

AUTOMATIC SET-UP WIRE DRAWER

FIELD OF THE INVENTION

The present invention generally relates to wire drawing machines, and ore particularly relates to apparatus for setting up and initially wrapping the capstan of the wire drawing machine.

BACKGROUND OF THE INVENTION

Wire drawing machines are typically used to unwind wire from a coil of wire, draw the wire through a drawbox for reducing the diameter of the wire, and for supplying the reduced diameter wire to a downstream production machine. Machines of this type are well known, and are described, for example, in U.S. Pat. Nos. 4,099,403, and 5,097,688, both assigned to the present assignee, and expressly incorporated by reference herein.

In such a wire drawing machine, the wire is initially provided in a wound coil which is supported on some sort of rotatable turntable. Wire from the coil is then manually threaded, or passed through a drawbox or die and is wrapped several times around a power-driven drum or capstan. When the capstan is rotated, it pulls wire through the drawbox so as to reduce the diameter of the wire, and the reduced diameter wire winds onto the capstan. While having a number of wraps remain on the capstan for drawing purposes, the wire is unwound and fed to the aforementioned downstream production station. As the wire is pulled by the capstan, the turntable rotates in order to allow the wire to unwind from the coil and to proceed to the drawbox.

With all currently known and used drawing machines, the process of setting up the machine, by threading the wire from the coil through the drawbox, and wrapping the wire around the capstan a sufficient number of times, is performed manually. More specifically, an operator needs to physically present the pointed end of the wire from the coil to the drawbox, and attach the end of the wire to some sort of attachment device provided on the capstan. The attachment device can be provided in the form of a manual gripper chain which holds the wire under tension, and which allows the wire to be released when not under tension, or can be provided in the form of a set screw or wedging device. The actual type of attachment device is typically dictated by the diameter of the wire being pulled. In any event, the process is completely manual wherein the operator needs to physically present the pointed end of the wire to the drawbox and physically attach the wire to the capstan. The operator then needs to jog the capstan forward to wrap the wire about the capstan a number of times sufficient to allow the wire to be pulled by the capstan from the coil as it rotates. Currently, the individual operator has great autonomy in determining the number of wraps provided on the capstan which can lead to an acceptable wrap, but which also can damage the capstan or wire drawing machine if performed improperly. In addition, time is required for the operator to jog the capstan forward sufficiently and accurately.

Once the capstan has the appropriate number of wraps, the capstan must be stopped, and the operator again must manually remove the end of the wire from the attachment device to free it from the capstan and allow it to be fed to a downstream production machine. Once the end of the wire is released from the capstan, the operator must jog the capstan forward again a sufficient amount to allow the wire to be trained around a compensation arm and be connected to the downstream production machine. The process is a time-intensive one which is economically detrimental to the operation in that any time devoted to the initialization or set-up of such a wire drawing machine, translates into downtime for the downstream production machine.

In addition to the time requirements of current machines and systems, the manual labor component also results in a potentially hazardous work environment. Since the operator needs to manually thread the wire through the drawbox and attach and release the end of the wire to the capstan at appropriate times, the operator's hands and clothing can potentially be caught in multiple pinch points provided on the machine. In addition, it is important to understand that the wire being drawn is quite often very large diameter wire with the entire coil weighing thousands of pounds. This not only compounds the hazardous nature of current systems, but also makes the process of manually threading and wrapping the wire a grueling and exhaustive one.

SUMMARY OF THE INVENTION

It is therefore an objective of the present invention to provide an apparatus for substantially automating the set-up process for a wire drawing machine.

It is another objective of the present invention to provide an apparatus and method for setting up a wire drawing machine which greatly reduces the time required over current systems, thereby allowing operators time to attend to other tasks.

It is another objective of the present invention to provide an apparatus and method for setting up a wire drawing machine with improved safety over current wire drawing machines.

It is a still further objective of the present invention to provide an apparatus and method for setting up a wire drawing machine with improved reliability, and less reliance on the skill of the individual operator.

In accordance with these objectives, it is a feature of a preferred embodiment of the present invention to provide a substantially automatic set-up system for a wire drawing machine comprising a capstan, a drawbox, means for releasably attaching an end of the wire to the capstan, means for aligning the drawbox outlet with the means for releasably attaching the end of the wire, and a processor adapted to automatically activate the aforementioned components. The capstan is adapted to have a plurality of wire coils wrapped therearound and pull wire from a wire supply as the capstan rotates. The drawbox is adapted to reduce the diameter of the wire from the supply as wire is pulled through the drawbox. The drawbox includes an inlet adapted to receive wire of a first diameter from the wire supply, and an outlet adapted to pay out wire of a second diameter to the capstan.

It is another feature of the preferred embodiment of the present invention to provide the means for releasably attaching in the form of a gripper hole in the capstan with a power actuated wedge which is adapted to engage the end of the wire inserted into the gripper hole and exert force against the wire to thereby hold the wire to the capstan.

It is another feature of a preferred embodiment of the present invention to provide the means for aligning in the form of a self-articulating mounting bracket for the drawbox, wherein the drawbox is aligned along a vertical axis via the bracket and gravity, and along a horizontal axis via a power actuated cylinder.

It is still another feature of a preferred embodiment of the present invention to provide the aforementioned automatic set-up system with a wire relaxer roller which exerts a first pressure against the wire when the means for releasably attaching is engaged, and which exerts a second, higher, pressure when the means for releasably attaching the wire is disengaged to thereby maintain the wire on the capstan, while still allowing a sufficient length of wire to be released from the capstan to be fed to the compensation arm and downstream production machine.

It is yet another feature of a preferred embodiment of the present invention to provide the set-up system described above and further including a guide tray which is adapted to receive the end of the wire after the means for releasably attaching the wire disengages, and align the end of the wire with the compensation arm of the wire drawing machine.

It is still another feature of a preferred embodiment of the present invention to provide the aforementioned automatic set-up system with an operator interface module such that the system is initiated simply by having the operator enter the number of desired wraps on the capstan, and initiating a start command.

It is another feature of a preferred embodiment of the present invention to provide a method for substantially automating the set-up process for a wire drawing machine of the type having a power-driven capstan adapted to rotate and thereby pull wire from a wire coil and through a drawbox. The method comprises the steps of aligning an exit of the drawbox with an attachment device on the capstan, presenting a pointed end of the wire from the coil through the drawbox and to the attachment device, attaching the end of the wire to the capstan by engaging the attachment device, rotating the capstan a predetermined number of revolutions to create a predetermined number of wraps on the capstan, and releasing the end of the wire from the capstan by disengaging the attachment device.

It is still another feature of a preferred embodiment of the present invention to use a sensor to continually monitor the home position of the capstan, and automatically stop the capstan at the home position when initiating the apparatus.

These and other objectives and features of the invention will become more apparent from the following detailed description when taken in conjunction with the accompanying drawings.

Figure 1:
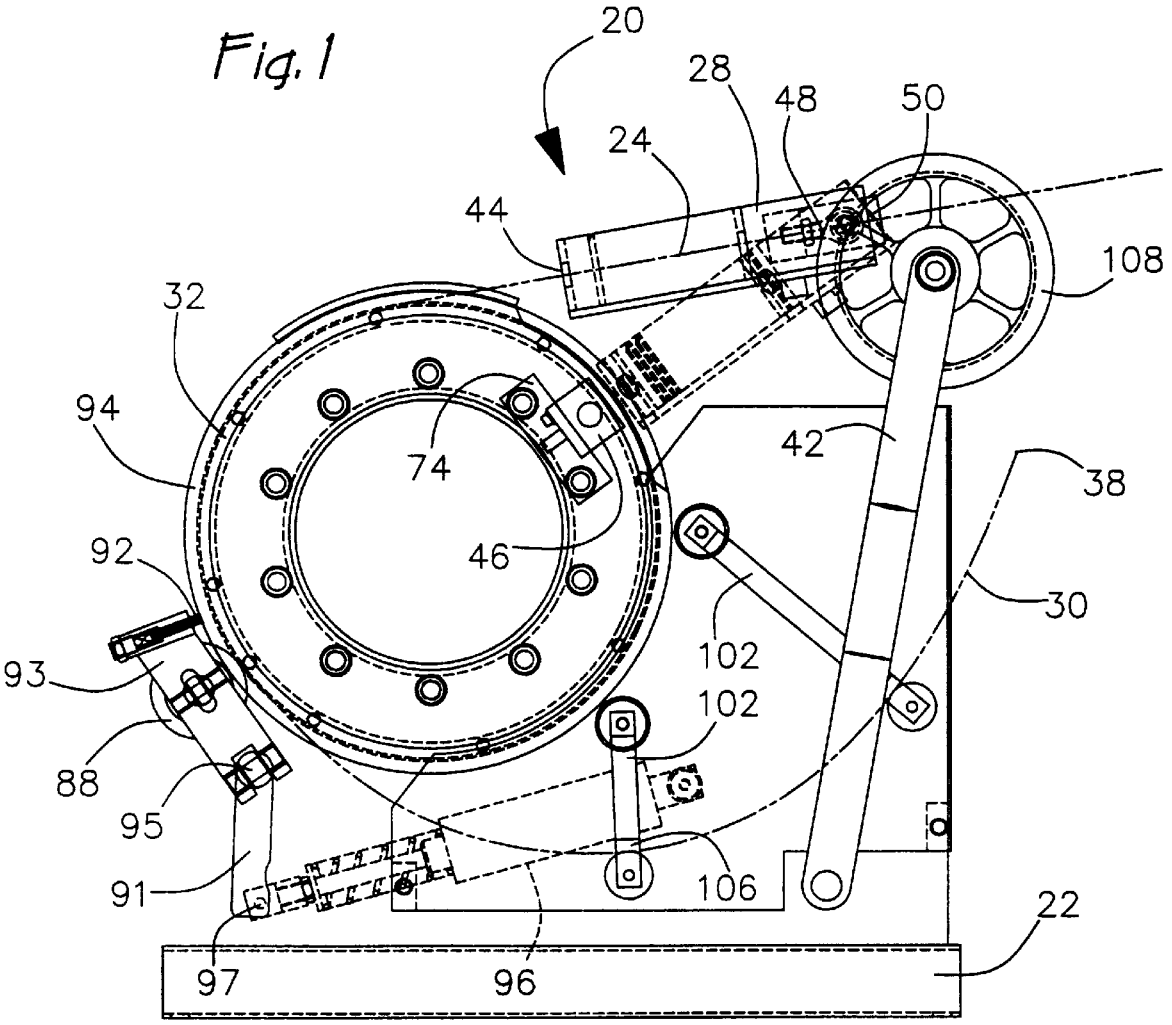
FIG. 1 is a side view of the preferred embodiment of the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to the drawings, and with specific reference to FIG. 1, the preferred embodiment of the present invention is generally depicted as a set-up system 20 for wire drawing machine 22. By way of overview, it is important to note that wire drawing machine 22 pulls wire 24 of a first diameter from coil 26 through drawbox 28 to result in wire 30 of a second, reduced diameter (See FIG. 6). Wire drawing machine 22 pulls wire 24 from coil 26 by wrapping the wire around the outer circumference of capstan 32 a number of times and rotating the capstan. Wraps 34 (See FIG. 5) remain on capstan 32 to provide a sufficient grip as capstan 32 rotates while end 38 of wire 30 is fed to a downstream production machine 40. While the preferred embodiment includes an electronic operator interface control module 86 having a processor in communication with a variable speed drive for controlling the speed of a motor and ultimately capstan 32, it is to be understood that a variety of drive systems, including hydraulic systems, can be used with the present invention to rotate capstan 32. However, in the preferred embodiment, the motor is connected to a pulley and gearbox 36 for rotating capstan 32.

Wire drawing machines currently need to be initiated or set-up manually, meaning that an operator has to physically thread the wire through the drawbox and attach it to the capstan, rotate the capstan a number of times, manually release the end of the wire from the capstan, and manually thread the wire from the capstan to the production machine while training the wire around compensation arm 42. The present invention eliminates the majority of the manual interaction with wire drawing machine 22 and provides a substantially automatic set-up system 20.

Figure 3:
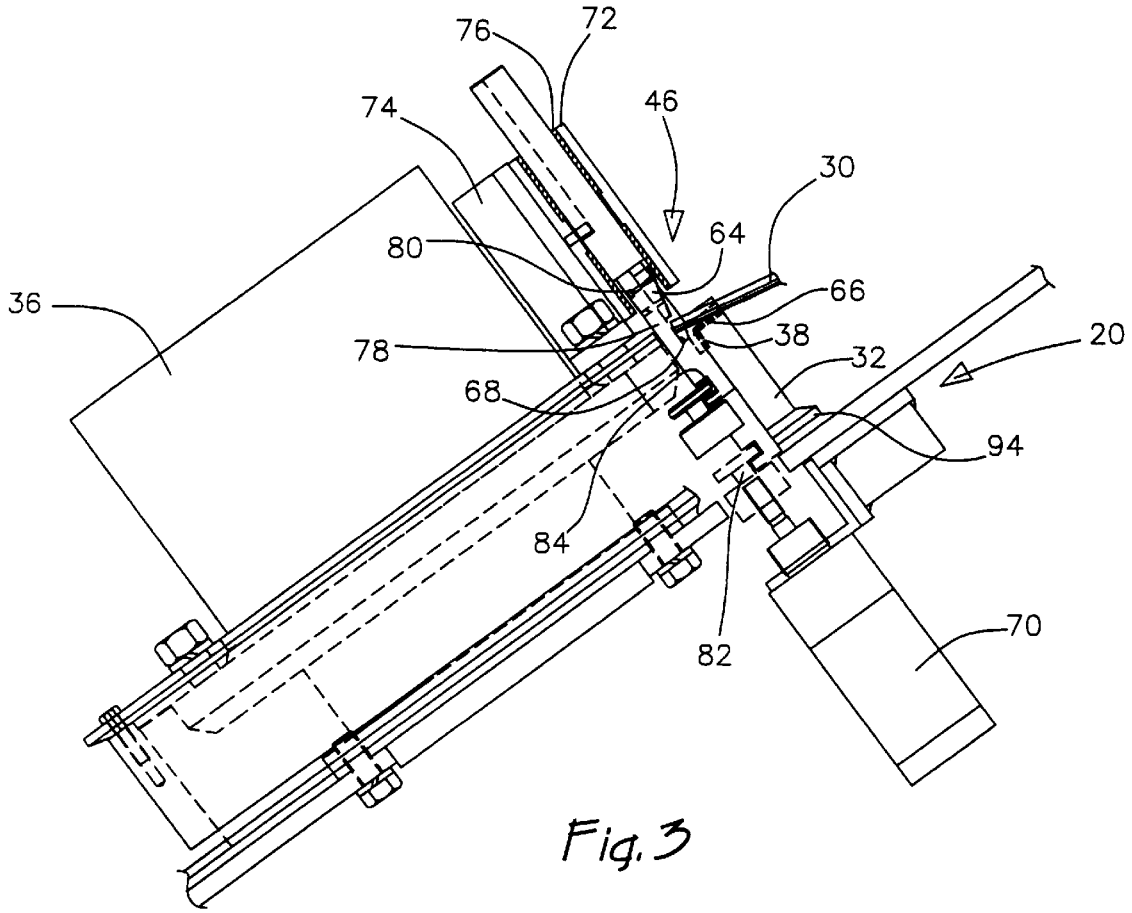
FIG. 3 is a top view of the embodiment shown in FIG. 1, specifically depicting the self-wedging gripper device.
Figure 4:
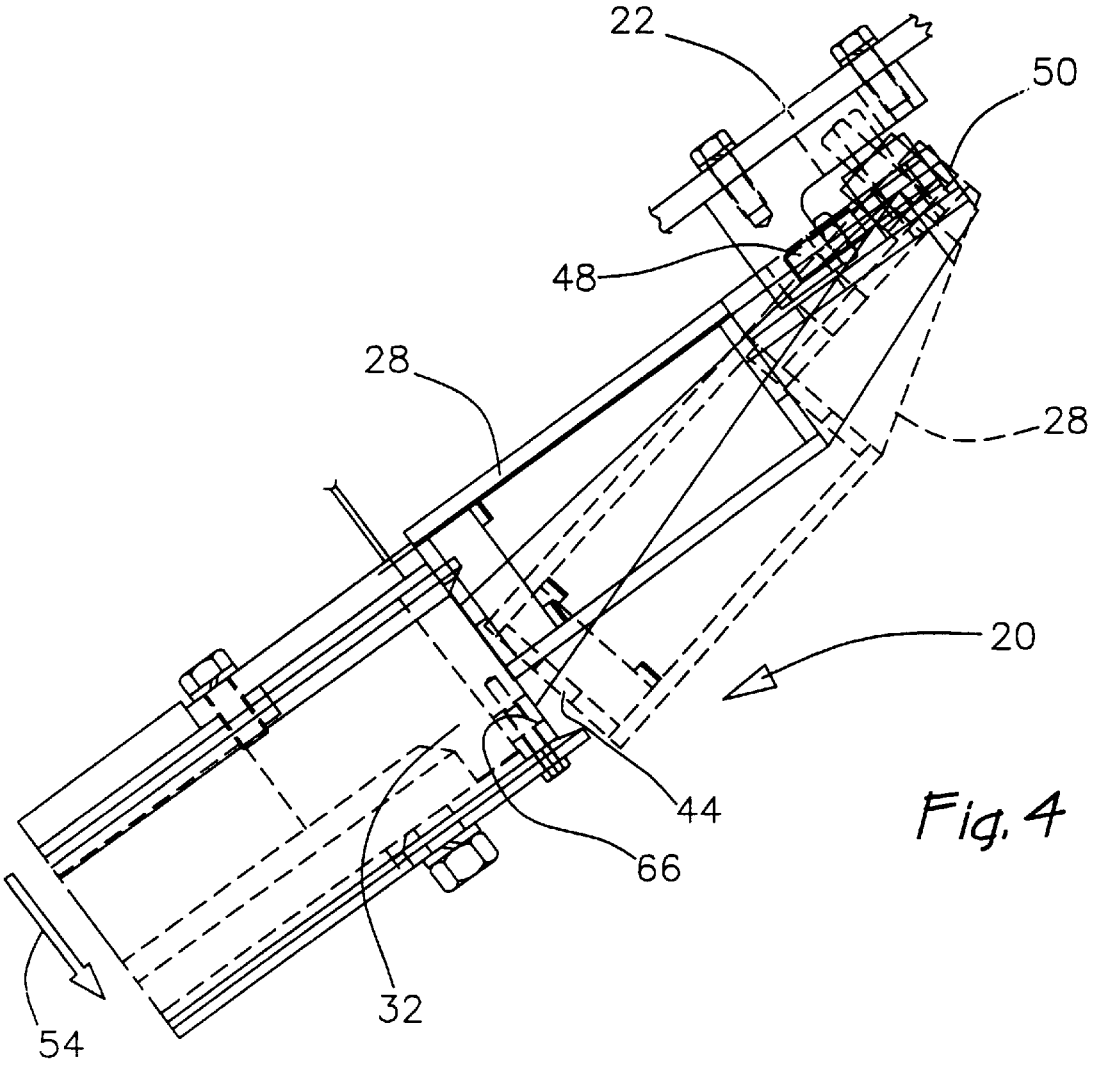
FIG. 4 is an enlarged view of the drawbox and its self-articulating pivot.

In order to substantially automate the system, one thing which needs to be accomplished is to automatically align outlet 44 of drawbox 28 with gripping mechanism 46 of capstan 32. The present invention therefore provides drawbox 28 on self-articulating pivot 48 as best shown in FIGS. 1, 3, and 4. The drawbox 28 itself is of conventional design in that it includes a die for reducing the diameter of wire 24 entering through inlet 50. However, pivot 48 is quite unique in that it allows the drawbox to pivot in a vertical direction as best depicted in FIG. 1 between the set-up position shown in dashed lines, and the run position shown in solid lines. The self-articulating pivot 48 also allows drawbox 28 to be aligned along a horizontal axis as best depicted in FIG. 4 to allow the outlet 44 of drawbox 28 to be aligned with gripper mechanism 46 on capstan 32. Movement of drawbox 28 in the vertical direction is governed by gravity and the force of the pulling wire on capstan 32, whereas movement of the drawbox 28 in the horizontal direction is governed by cylinder 52 which in the preferred embodiment is an air cylinder, but which can be any type of linear actuator, including electric and hydraulic cylinders.

Figure 2:
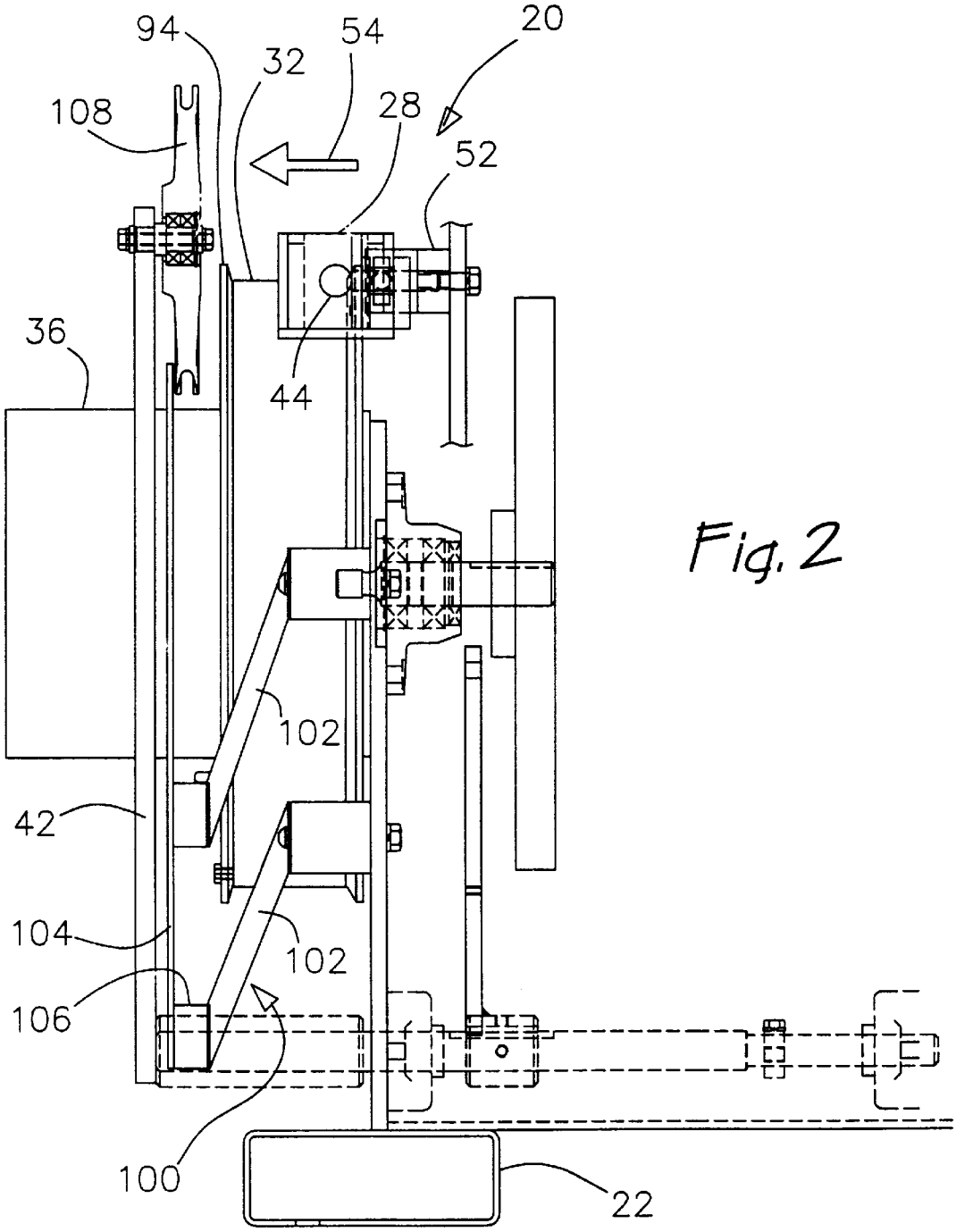
FIG. 2 is an end view of the embodiment shown in FIG. 1, specifically depicting the guide tray and alignment thereof with the compensation arm.
Figure 7:
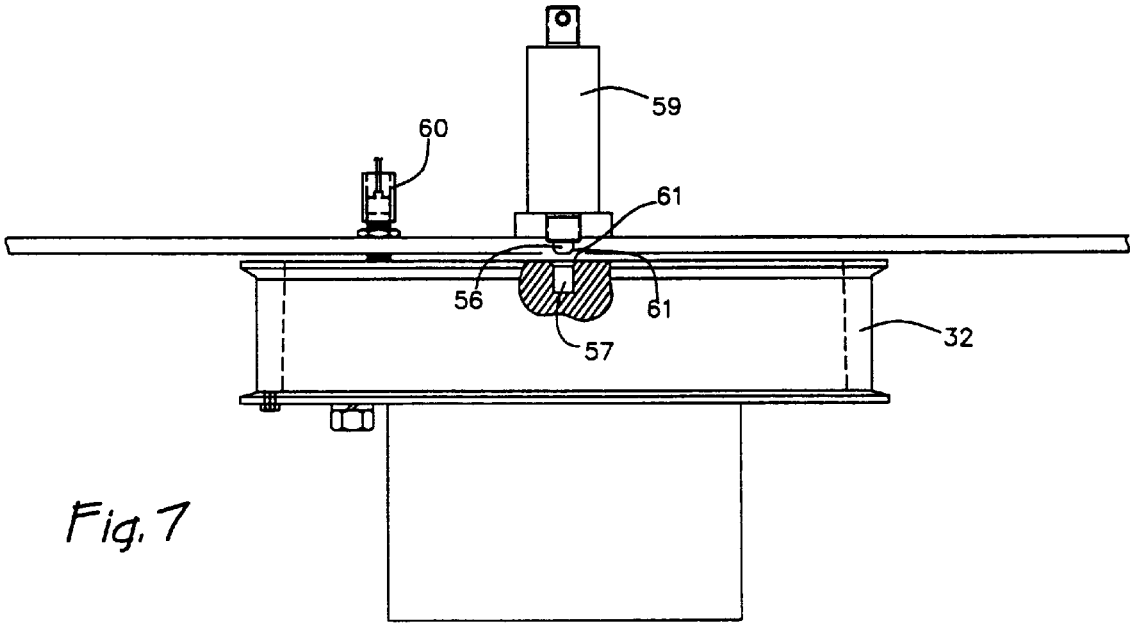
FIG. 7 is an enlarged view of the capstan, home position sensor and shot pin cylinder.

Drawbox 28 is therefore aligned into the set-up position by allowing gravity to pull drawbox 28 to its lowest position shown in FIG. 1, and activating drawbox cylinder 52 to push drawbox 28 in an outboard direction, represented by arrow 54 in FIG. 2, in order to align outlet 44 of drawbox 28 with gripper mechanism 46 of capstan 32. Capstan 32 is provided with a home position depicted in FIG. 1 wherein gripper mechanism 46 is aligned with outlet 44 of drawbox 28. Since capstan 32 is power-driven by a motor, a mechanism is provided to quickly and exactly stop capstan 32 and gripper mechanism 46 in the home position. This is, in the preferred embodiment, provided in the form of the variable speed drive of operator interface control module 86 which, along with a processor and sensor 60, is able to monitor the position of the home position and allow the capstan 32 to rotate thereto. A variety of braking devices can then be used to precisely stop capstan 32, in the preferred embodiment being mechanical shot pin 56 which is fired into aperture 57 provided in capstan 32 when gripper mechanism 46 is in its home position (See FIG. 7). Such action immediately stops rotation of capstan 32 and does not allow capstan 32 to coast due to momentum. More specifically, sensor 60 is provided to monitor the position of capstan 32 in degrees relative to the home position and communicates this data to control module 86. Control module 86 then directs the variable speed drive and motor to begin breaking capstan 32 to stop approximately at the home position. Mechanical shot pin 56, as shown in FIG. 7, is then fired into aperture 57 by cylinder 59 to secure capstan 32 exactly at the home position. Both aperture 57 and shot pin 56 include chamfers 61 to facilitate this motion in the preferred embodiment. Also in the preferred embodiment of the present invention, sensor 60 is provided in the form of a proximity switch, but any number of sensors, including photo-electric cells, and the like, can be employed with similar efficacy. Cylinder 59 is preferably an air cylinder but can be any type of linear actuator including electric, pneumatic, and hydraulic. Moreover cylinder 59 is preferably mounted on an adjustable plate so that its position can be modified to suit variation in machines.

Once the drawbox outlet 44 is aligned with gripper mechanism 46, and shot pin 56 has engaged to secure capstan 32 in the home position, the operator will present pointed end 38 of wire 30 through drawbox 28 and into engagement with gripper mechanism 46. Gripper mechanism 46 will then be engaged to clamp end 38 onto capstan 32 such that when capstan 32 begins rotation, wire 30 will be pulled from coil 26. In the preferred embodiment of the present invention, gripper mechanism 46 is provided in the form of a wedge 64 adapted to exert force on end 38 against capstan 32 and thereby hold wire 30 in position. Gripper hole 66, as best shown in FIG. 3, is provided in capstan 32 to allow end 38 to be fed therethrough and hit fixed stop 68 of gripper mechanism 46. Gripper mechanism 46 is then activated to thereby cause wedge 64 to engage end 38 and bend wire 30 from the position shown in solid lines in FIG. 3 to the position shown in dashed lines in FIG. 3. Wedge 64 is "self-wedging" in that as it is pulled into position, it will stay in the wedged position until force is supplied by cylinder 70 to remove it. Cylinder 70 is preferably pneumatic, but can be an type of linear actuator including electric and hydraulic cylinders.

Gripper mechanism 46 also includes a housing 72 which is affixed to the torque bolt cluster 74 of machine 22. Wedge 64 is able to reciprocatingly slide in and out of channel 76 provided in housing 72. In the preferred embodiment of the present invention, wedge 64 is separately attached to rod 78 via set screws 80 such that wedge 64 can be easily replaced after extended usage.

In order to slide rod 78 in and out of channel 76, cylinder 70 is equipped with flanged tool 82 adapted to interfit with groove 84 provided in rod 78. Since flanged tool 82 is able to extend from and retract relative to cylinder 70, rod 78 is thereby moved in and out of channel 76 due to the engagement of flanged tool 82 and groove 84 as best shown in FIG. 3.

Therefore, gripper mechanism 46, and more specifically rod 78, is adapted to move from the disengaged position, wherein rod 78 is fully received into channel 76, and the engaged position wherein rod 78 is fully removed from channel 76, entirely within the interior of capstan 32, and self-wedged to hold end 38 of wire 30 to capstan 32. Wedge 64 and rod 78 therefore rotate with capstan 32 when in the engaged position. When it is desired to release end 38 of wire 30 from gripper hole 66, cylinder 70 is extended to thereby force rod 78 into channel 76, as will be discussed with further detail herein.

Once the end 38 of wire 30 is attached to capstan 32 via gripper mechanism 46, control module 86, after a time delay, causes the motor to rotate capstan 32. The number of times capstan 32 rotates is dictated by the information entered to control module 86. Toward that end, machine 22 is provided with an operator interface module 86 to allow the operator to enter, among other things, the predetermined number of desired wraps 34, and to initiate the set-up process.

Capstan 32 will then rotate the predetermined number of times as counted by sensor 60 in conjunction with control module 86. At this point, wire 30 has been wrapped onto capstan 32 to a sufficient degree such that, as capstan 32 rotates, wire 24 is pulled from coil 26 and through drawbox 28. However, in order to feed the end 38 of wire 30 to the downstream production machine 40, end 38 must first be released from gripper hole 66. Before doing so, wire relaxer roller 88 must be engaged to ensure that wraps 34 do not become completely disengaged from capstan 32, but only that a sufficient length of wire 30 is freed to allow it to be trained around compensation arm 42 and connected to production machine 40. The use of wire relaxer rollers 88 are not new to the industry, but, the apparatus and method for automatically engaging the wire relaxers as disclosed herein, is novel.

Figure 5:
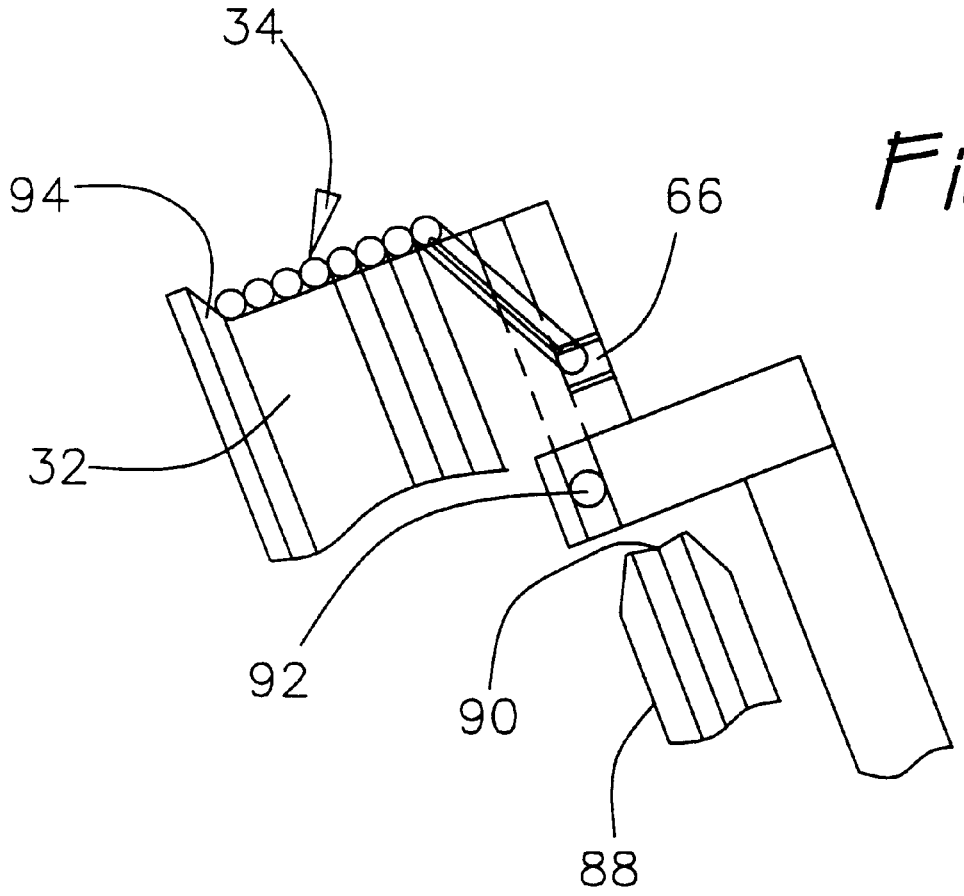
FIG. 5 is an enlarged view of the capstan with multiple wire wraps thereon, and the cooperation of the wire relaxer roller and guide pin with the wraps.

Referring now to FIGS. 1 and 5, wire relaxer roller 88 is depicted in further detail. As shown therein wire relaxer roller 88 includes a V-shaped annular groove 90 which is adapted to ride along the outer circumference of wires 30. The shape of groove 90 facilitates this engagement. When capstan 32 has rotated the predetermined number of times and wraps 34 are provided on the outer circumference of capstan 32, wire relaxer roller 88 is engaged using a first pressure against wire 30.

Figure 9A:
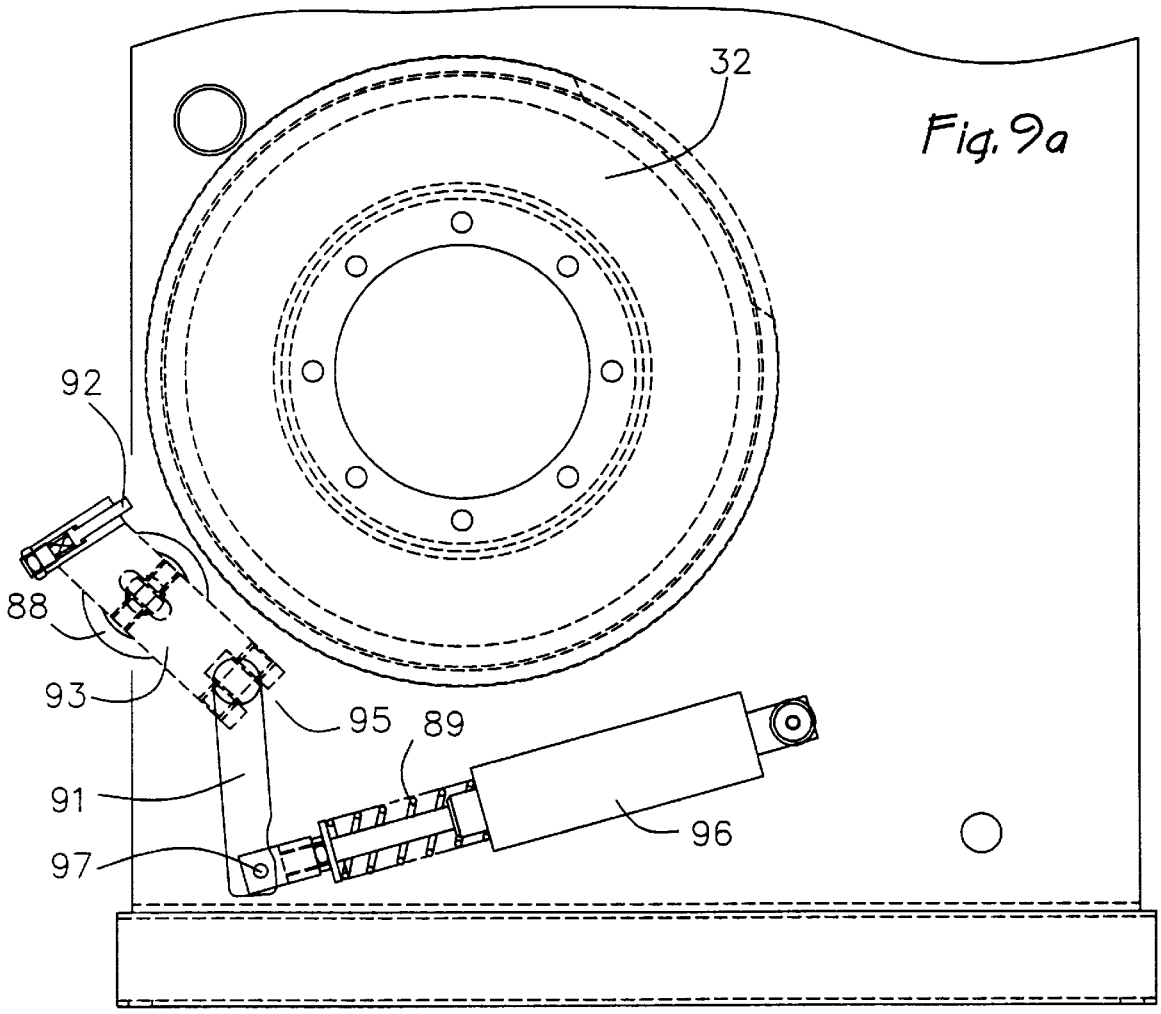
FIG. 9A is a side view of the capstan with the wire relaxer disengaged.
Figure 9B:
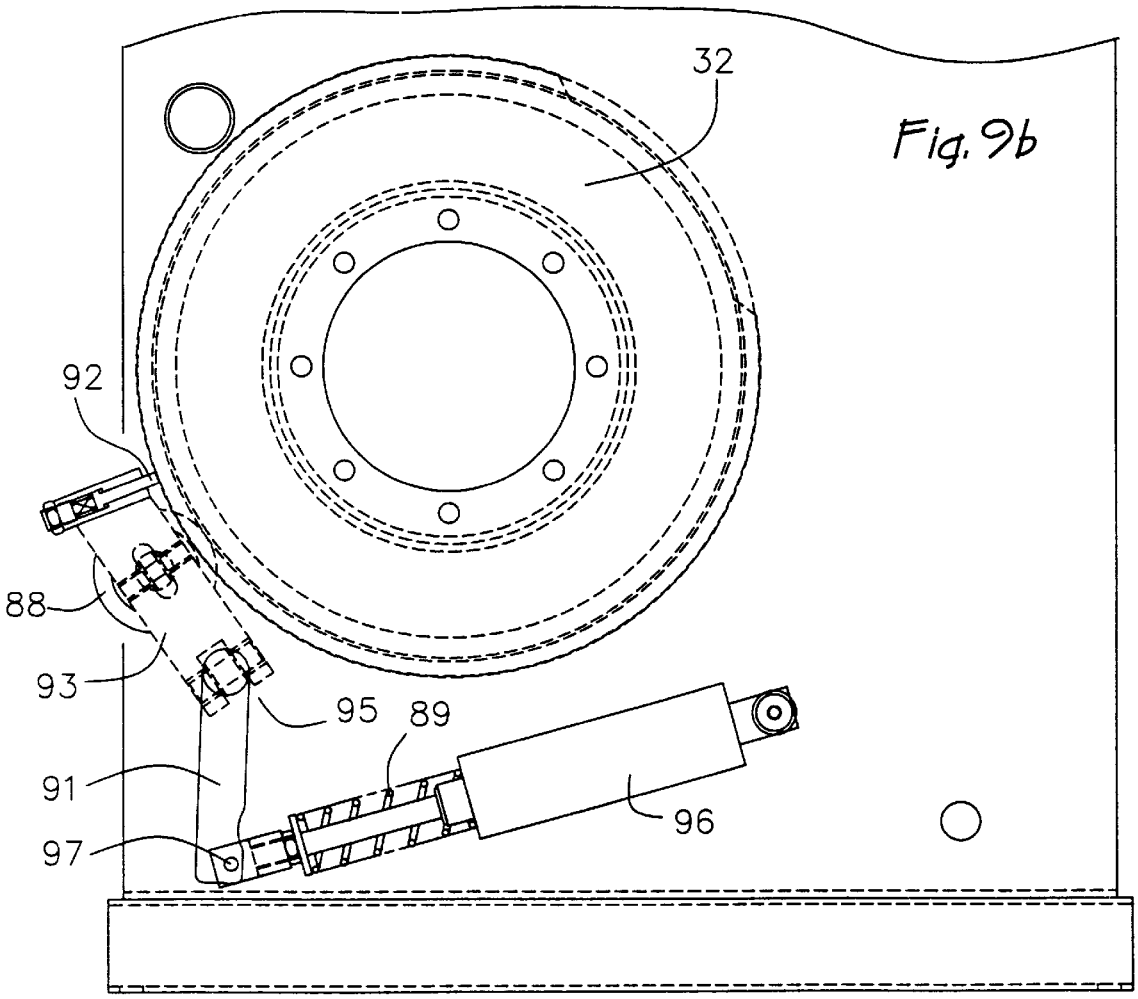
FIG. 9B is a side view of the capstan with the wire relaxer in the first engaged position.
Figure 9C:
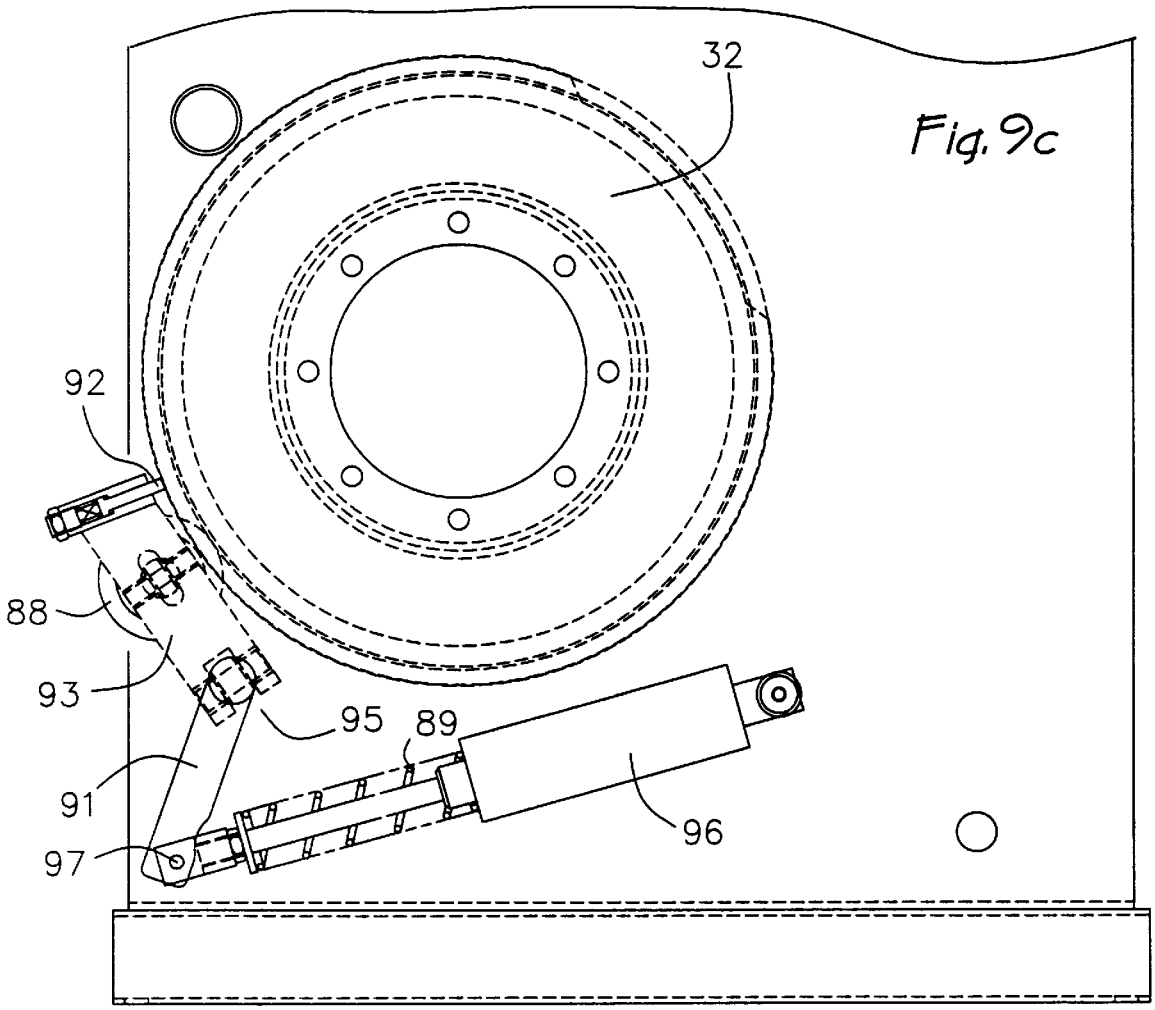
FIG. 9C is a side view of the capstan with the wire relaxer in the second engaged position.

More specifically, cylinder 96 as shown in FIGS. 9A–9C is engaged to bring the wire relaxer roller 88 from the disengaged position depicted in FIG. 9A to the first engaged position against capstan 32 as depicted in FIG. 9B. Cylinder 96 is double-acting cylinder used in conjunction with multi-positioning control valves such that a fully retracted, intermediate, and fully extended position can be achieved based on appropriate signals from the operator control interface. Since varying degrees of wire relaxer force are required, spring 89 is used in conjunction with cylinder 96 as follows:

As shown in FIG. **9*a*, spring 89 is compressed by the force of the cylinder so that the wire relaxer roller 88** does not contact the capstan or wire. Fluid flow is blocked at port B such that the cylinder fully retracts.

As shown in FIG. 9*b*, fluid flow is approximately equal at ports A and B and the cylinder extends allowing the wire relaxer roller 88 to contact the wire on the capstan with light pressure. The degree of pressure, or force, is determined by the design of the spring. An amount sufficient to contact the wire and guide it is necessary. More force than necessary would be detrimental to the operation of automatic set-up since the last wire could not freely move along the axis of the capstan.

As shown in FIG. 9*c*, fluid flow is blocked at port A and the cylinder is allowed to fully extend. At this point, the force delivered by spring 89 is inconsequential and the entire wire relaxer force delivered to roller 88 is dependent on the pressure and size of the fluid system. It is expected that in the fully extended mode, cylinder 96 would deliver a force which is many times that of the spring.

Figure 8:
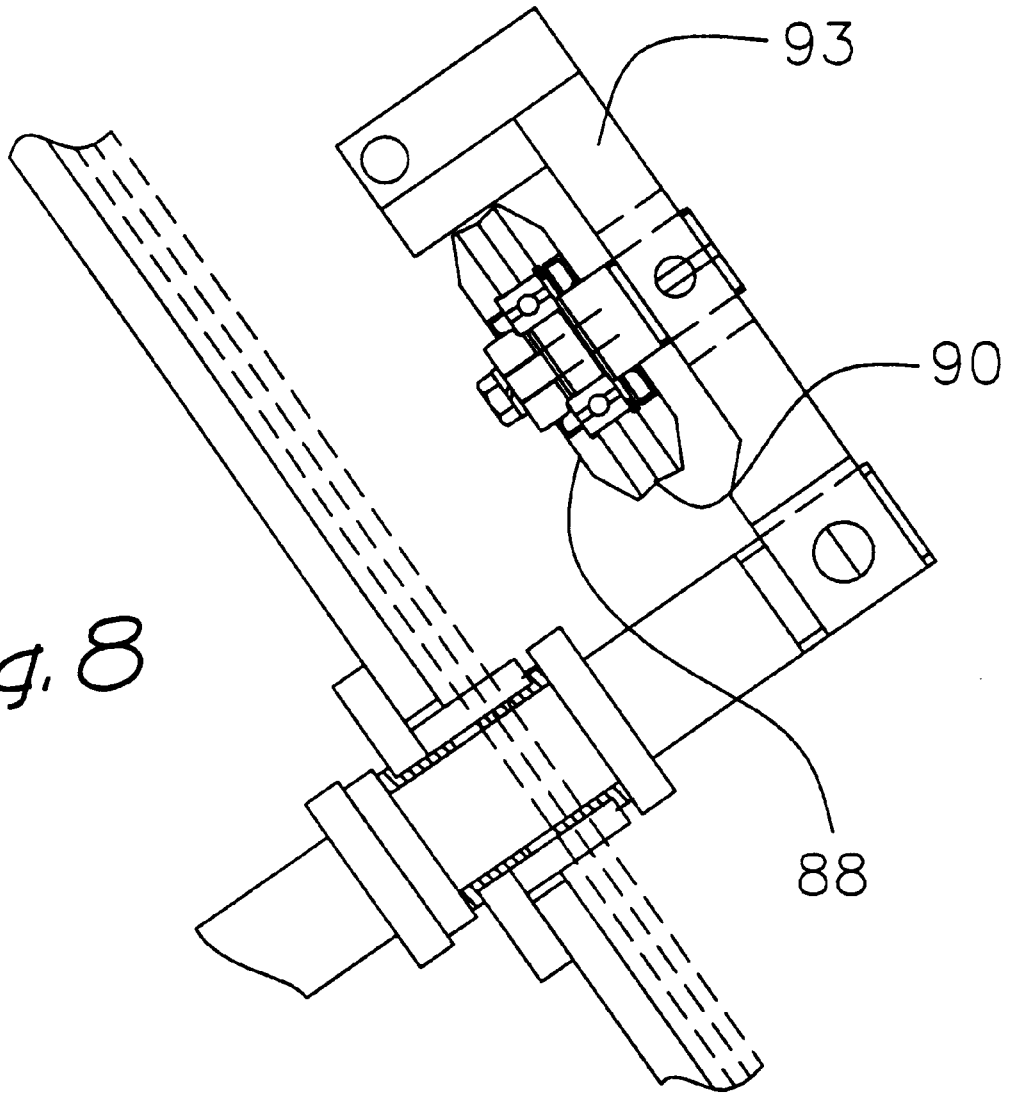
FIG. 8 is an enlarged top view of the wire relaxer.

When wire relaxer roller 88 is aligned with the outboard position of wire 30 such that it finds the first wrap 34 extending from gripper hole 66, the operator interface control module 86 directs capstan 32 to rotate one full revolution. The wire relaxer roller 88 follows wire 30, and guide pin 92, mounted to relaxer base 93, "peels" one wrap of wire away from the body of wraps 34 extending back to flange 94 on the inboard side of the capstan 32. As shown in FIGS. 9A–9C, wire relaxer arm 91, and wire relaxer base 93 are pivotally connected at boss 95, and arm 91 is pivotally connected to cylinder 96 at pivot 97 facilitate pivoting in both a lateral direction across capstan 32 and a vertical direction normal to capstan 32. FIG. 8 illustrates the direction of motion in the lateral direction.

Cylinder 96 is preferably and air cylinder, but could also be hydraulic. Moreover cylinder 96 can include a pressure switch to allow the force of engagement to be varied based on wire diameter.

Once capstan 32 has rotated a full revolution, a second, higher, pressure is applied by wire relaxer roller 88 against wire 30 as shown in FIG. 9C. The second, stronger, pressure, of the preferred embodiment is provided by further extending cylinder 96 and spring 89. The second stronger pressure is required because once the gripper mechanism 46 is released, and capstan 32 rotates to allow the end 38 of 30 to be freed from gripper holes 66 and spring naturally outwardly following the natural arcuate cast of the coil 26. The capstan rotates enough to allow sufficient wire to be freed for training around compensator arm 42 and to production machine 40. This amount is a fixed length based on the size of the wire being drawn. But for the pressure applied by cylinder 96 against wire relaxer roller 88, all wraps 34 would become less tightly engaged with capstan 32 such that upon rotation of capstan 32, wire 24 would not be pulled from coil 26. Wire relaxer roller 88 therefore maintains engagement of wraps 34 with capstan 32, while at the same time allowing a sufficient length of wire 30 to be freed from capstan 32 to thereby be connected downstream to production machine 40.

Once wire relaxer roller 88 is engaged with the second stronger pressure, and gripper mechanism 46 is disengaged, capstan 32 will again be signaled to rotate which, as already mentioned, will cause end 38 to be released from gripper holes 66 and fall away following its natural arcuate cast into guide tray 100 (See FIGS. 1 and 2). In the preferred embodiment of the present invention, guide tray 100 is provided in the form of a pair of angled baffle plates 102 which extend from an inboard side of machine 22 to the outboard side of machine 22, and are connected to outer shroud 104 as best depicted in FIG. 2. Baffle plates 102 and shroud 104 thereby cooperate to form a valley 106 into which the end 38 of wire 30 naturally falls upon release. Valley 106, as best shown in FIG. 2, is aligned with roller 108 provided on compensation arm 42. By aligning valley 106 with roller 108, wire 30 can be more easily trained around roller 108 and eventually be fed to production machine 40.

Figure 6:
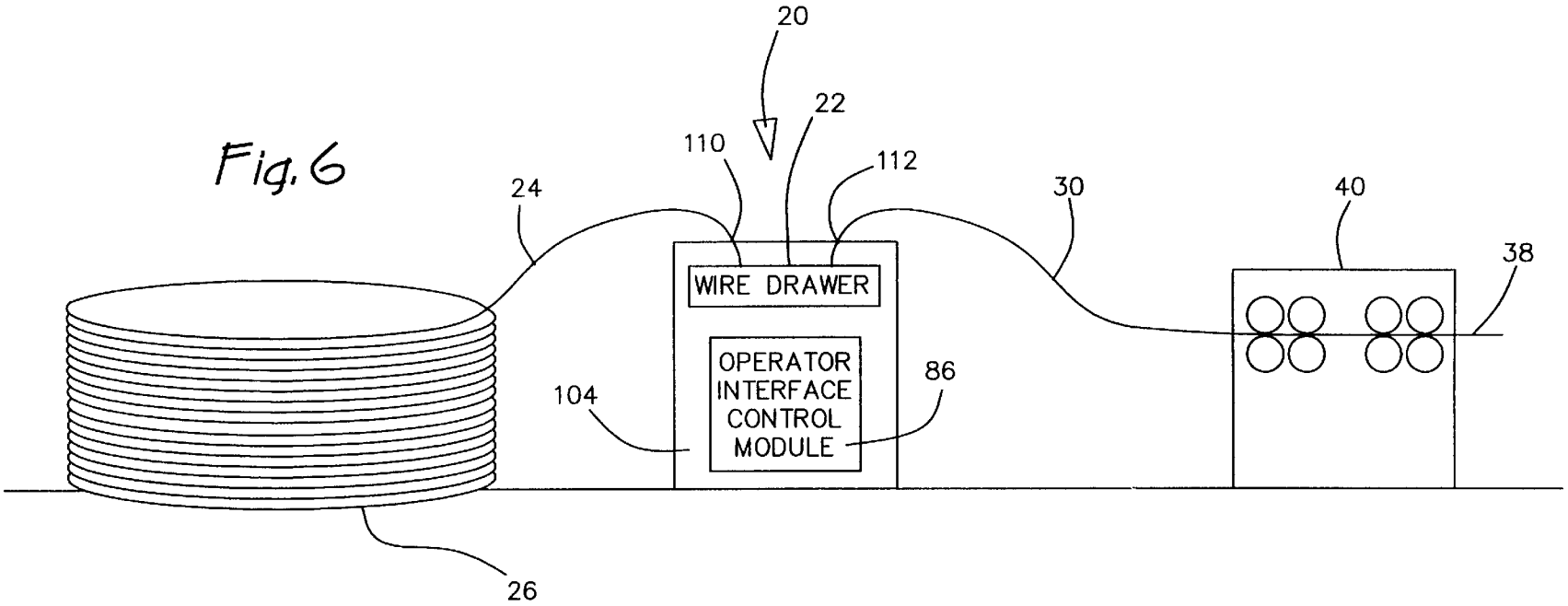
FIG. 6 is a schematic representation of a preferred embodiment of the present invention showing the coil to be unwound, the present invention with a protective shroud completely therearound and having one inlet and one outlet, and a downstream production machine.

In the preferred embodiment of the present invention, as schematically depicted in FIG. 6, shroud 104 completely encloses machine 22 and is simply provided with an inlet slot 110 and an outlet slot 112. An operator therefore simply needs to present pointed end 38 of wire 24 into inlet slot 110 to initiate system 20, which in turn causes end 38 to be exhausted from outlet slot 112 for eventual connection to production machine 40. Not only does this reduce the time required by the operator for initiating or setting up machine 22, but due to shroud 104, the possibility of the operator becoming injured is greatly reduced.

The present invention is not only directed to the apparatus of system 20, but also the method of substantially automating the set-up process for a wire drawing machine 22 with minimal operator interaction, greater reliability, less downtime, and greatly improved safety. In operation, the method of the present invention is initiated by an operator entering the number of wraps desired on capstan 32 and an initialization command, through operator interface control module 86. This causes capstan 32 to rotate to its home position as monitored by sensor 60. Mechanical shot pin 56 is then engaged to lock capstan 32 at the home position. Simultaneously with this operation, drawbox cylinder 52 is extended to cause outlet 44 of drawbox 28 to be aligned with gripper mechanism 46.

The operator then presents pointed end 38 of wire 24 through drawbox 28 until it hits fixed stop 68 of gripper mechanism 46. It is at this point that the operator then enters a start command through control module 86 which causes gripper mechanism 46 to be engaged. More specifically, rod 78 is pulled out of channel 76 via wedge cylinder 70 and wedge 64 exerts force against end 38 against the inner circumference of capstan 32 to lock wire end 38 into place.

Control module 86 then causes shot pin 56 to disengage and capstan 32 to rotate the predetermined number of times as monitored by sensor 60. Once the predetermined number of wraps 34 have been placed onto capstan 32, control module 86 slows capstan 32 to stop at the home position. After a time delay, wire relaxer roller 88 is engaged using a first pressure against wire 30 and the capstan 32 is rotated one revolution to allow the wire relaxer roller 88 to follow the wire and peel a first wrap away from the remaining body of wraps on capstan 32. A second stronger pressure is then applied by wire relaxer roller 88 at this point.

Gripper mechanism 46 is then disengaged by pushing rod 78 back into channel 76 by wedge cylinder 70. After a time delay, capstan 32 is then caused again to rotate which causes end 38 to be removed from gripper hole 66 back to the point where wire relaxer roller 88 forces wire 30 against capstan 32. This frees a sufficient length of wire 30 from the capstan 32 to allow the wire 30 to be connected to production machine 40.

At this point, wire 30 springs away from capstan 32 following its natural arcuate cast and falls into guide tray 100. More specifically, wire 30 hits baffle plates 102 which directs wire 30 into valley 106 defined by baffle plates 102 and shroud 104. Since valley 106 is aligned with roller 108 of compensation arm 42, wire 30 can be easily trained around roller 108 and ultimately be connected to downstream production machine 40. At this point the wire drawing machine 22 has completed the set-up method, and is ready to be connected to the production machine.

Since the operator control interface module is an "intelligent" device which controls the set-up operation, this inherent intelligence may be used to perform other functions. For example, based on an operator input of model number, capstan diameter, and wire size, the module could automatically determine the required number of wraps and wire roller relaxer pressure. In addition, different wire materials and diameters could be entered by the operator to make a determination as to whether the area reduction is within safe guidelines, and whether the wire drawer could satisfactorily run production. The outputs could be displayed on a suitable readout, such as LCD display. Moreover, for purposes of honoring warranties and monitoring performance, the interface module could keep track of material types and wire sizes actually run in a production mode. In addition, the interface module could record Drawbox Force and actual hours of run time. Users of the wire drawer could monitor the hours run with the intent of setting up preventive maintenance schedules. This would eliminate costly production down-time in the event the machine needed immediate service.

This would be very useful to a manufacturing operation having machines which are frequently moved from one location to another.

From the foregoing it can therefore be appreciated by one of ordinary skill in the art that the present invention provides a set-up system for substantially automating the initialization and set-up process for a wire drawing machine. Since the process is substantially automated, the time required for setting up a wire drawing machine is substantially reduced over prior art methods. This directly equates into more production time, more produced end product, and higher profits. Moreover, by substantially automating the process, less operator interface is required which thereby reduces the likelihood of injury to the operator and results in a greatly safer system, while improving reliability in that less responsibility is placed on the individual operator. Other tests can be done concurrently by the operator.

What is claimed is:

1. A substantially automatic set-up system for a wire drawing machine, comprising:

a power-driven capstan adapted to have a plurality of wire coils wrapped therearound and pull wire from a wire supply as the capstan rotates;

a drawbox adapted to reduce the diameter of the wire from the supply as wire is pulled through the drawbox, the drawbox having an inlet adapted to receive wire of a first diameter from the wire supply and an outlet adapted to pay out wire of a second diameter to the capstan;

a gripper mechanism adapted to releasably attach an end of the wire of a second diameter to the capstan;

an automatic pivot supporting the drawbox adapted to align the drawbox outlet with the gripper mechanism; and a processor adapted to activate the automatic pivot and the gripper mechanism, and cause the capstan to rotate upon initiation of the system by an operator.

2. The substantially automatic set-up system of claim 1 wherein the capstan includes a gripper hole, and the gripper mechanism includes a wedge adapted to engage the end of the wire inserted into the gripper hole and exert force against the wire to thereby hold the wire end to the capstan.

3. The substantially automatic set-up system of claim 2 wherein the wedge is moved from an engaged position to a disengaged position by an air cylinder.

4. The substantially automatic set-up system of claim 2 wherein the drawbox is aligned along a vertical axis with the gripper hole due to gravity, and along a horizontal axis by the automatic pivot.

5. The substantially automatic set-up system of claim 4 wherein the automatic pivot includes an air cylinder attached to the drawbox, and a variable speed drive and motor adapted to stop rotation of the capstan at a home position, the drawbox outlet being aligned with the gripper hole only at the home position of the capstan.

6. The substantially automatic set-up system of claim 4 wherein the automatic pivot includes an air cylinder attached to the drawbox, and a shot pin adapted to move into an aperture provided in the capstan to stop the capstan at a home position, the drawbox outlet being aligned with the gripper hole only at the home position of the capstan.

7. The substantially automatic set-up system of claim 1 further including a wire relaxer roller adapted to depress the wire against the capstan to prevent the wire from completely disengaging the capstan when the gripper mechanism releases the end of the wire.

8. The substantially automatic set-up system of claim 7 wherein the wire relaxer exerts a first pressure against the wire when the gripper mechanism is engaged, and a second, higher pressure when the gripper mechanism is disengaged.

9. The substantially automatic set-up system of claim 8 wherein the first and second pressures are derived from an air cylinder.

10. The substantially automatic set-up system of claim 7 wherein the wire relaxer further includes a guide pin to pull a first wrap of the wire wrapped around the capstan away from remaining wraps.

11. The substantially automatic set-up system of claim 1 further including a guide tray adapted to receive the end of the wire after the gripper mechanism disengages, the natural arcuate cast of the wire causing the wire to move into the guide tray.

12. The substantially automatic set-up system of claim 11 wherein the guide tray includes angled sides adapted to direct the wire into a predetermined position, the predetermined position being aligned with a compensation arm of the wire drawing machine to thereby facilitate threading of the wire around the compensation arm and to a downstream production machine.

13. The substantially automatic set-up system of claim 1 further including an operator interface control module, the system being initiated upon an operator entering the number of desired wraps on the capstan and a start command into the operator interface control module, the operator interface control module causing the capstan to rotate the desired number of times.

14. The substantially automatic wire set-up machine of claim 13 further including a proximity switch to sense the number of revolutions and home position of the capstan and send a signal to the operator interface control module to stop the capstan upon reaching the predetermined number of revolutions and the home position.

15. A method for substantially automating the set-up process for a wire drawing machine of the type having a power driven capstan adapted to rotate and thereby pull wire from a wire coil and through a drawbox, the method comprising the steps of:

aligning an exit of the drawbox with an attachment device on the capstan by pivoting the drawbox;

presenting a pointed end of the wire from the coil, through the drawbox and to the attachment device;

attaching the end of the wire to the capstan by engaging the attachment device;

rotating the capstan a predetermined number of revolutions to create a predetermined number of wraps on the capstan;

releasing the end of the wire from the capstan by disengaging the attachment device; and wherein each of the aligning, attaching, rotating, and releasing steps is controlled by a control module of the wire drawing machine.

16. The method of claim 15 wherein the aligning step is performed by rotating the capstan to a home position and moving the drawbox along a horizontal axis using a pressurized cylinder, movement of the drawbox along a vertical axis being governed by gravity and a self-articulating pivot.

17. The method of claim 15 wherein the feeding step is performed manually by the operator.

18. The method of claim 15 wherein the attaching step is performed by wedging the end of the wire between the attachment device and an inner surface of the capstan.

19. The method of claim 15 wherein the attachment device is a wedge adapted to slide at the command of an air cylinder.

20. The method of claim 15 further including the steps of engaging a wire relaxer roller against the wire and the capstan, and rotating the capstan one revolution prior to the releasing step.

21. A wire drawing machine of the type having a power-driven capstan and a drawbox, the capstan adapted to receive a number of wire wraps around the outer circumference of the capstan to thereby pull wire from a coil upon rotation of the capstan, the drawbox being disposed between the coil and the capstan to reduce the diameter of the wire when the wire is pulled through the drawbox, the wire drawing machine comprising:

a wedge attached to the capstan and adapted to selectively move relative to a gripper hole and thereby hold wire inserted into the gripper hole to the capstan, the gripper hole being provided in the outer circumference of the capstan;

a self-articulating mounting bracket attached to the drawbox, the drawbox being positioned along a vertical axis by the bracket and gravity, the drawbox being positioned along a horizontal axis by a retractable cylinder attached to the drawbox and the wire drawing machine;

means for stopping rotation of the capstan at a home position, the home position being where the gripper hole is aligned with an outlet of the drawbox;

a sensor adapted to monitor rotational position of the gripper hole, the home position, and the capstan; and an operator interface module adapted to receive input from an operator including the number of desired wraps for the capstan and a start command and adapted to receive signals from the sensor and control movement of the wedge, drawbox cylinder, and means for stopping.

22. The wire drawing machine of claim 21 further including a wire relaxer roller mounted to the machine proximate the outer circumference of the capstan, the roller including a channel adapted to ride along the wire wraps, the roller exerting force against the wire to hold the wire against the capstan even after the wedge is moved away from the gripper hole.

23. The wire drawing machine of claim 22 further including a spring to bias the wire relaxer roller against the wire wraps, and a guide pin adapted to pull one wire wrap toward the wire relaxer upon rotation of the capstan.

24. The wire drawing machine of claim 23 further including a pressurized air cylinder attached to the wire relaxer to force the wire against the capstan with greater pressure than the spring when the wedge is moved away from the gripper hole.

25. The wire drawing machine of claim 24 further including means for guiding the wire into alignment with a compensation arm attached to the machine after the wedge moves away from the gripper hole and releases a portion of the wire from the gripper hole to the wire relaxer roller.

26. The wire drawing machine of claim 25 wherein the means for guiding includes a pair of angled plates attached to the machine and an outer shroud, the angled plates and shroud defining a channel into which the wire springs upon release of the wedge, the wire springing away from the capstan given its natural arcuate cast, the channel being aligned with the compensation arm to facilitate training thereto and feeding of the wire to a downstream production apparatus.

27. The wire drawing machine of claim 26 wherein the shroud covers the entire wire drawing machine and includes one inlet slot for receipt of wire from the wire coil, and one outlet slot for exhaust of wire to a downstream production apparatus.

* * * * *